US007386991B2

(12) United States Patent
Kim et al.

(10) Patent No.: US 7,386,991 B2
(45) Date of Patent: Jun. 17, 2008

(54) HERMETIC COMPRESSOR

(75) Inventors: Jong-Mog Kim, Kyeongsangnam-Do (KR); O-Sup Kwon, Kyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 496 days.

(21) Appl. No.: 10/530,749

(22) PCT Filed: Mar. 24, 2003

(86) PCT No.: PCT/KR03/00576

§ 371 (c)(1),
(2), (4) Date: Apr. 8, 2005

(87) PCT Pub. No.: WO2004/025121

PCT Pub. Date: Mar. 25, 2004

(65) Prior Publication Data

US 2006/0233652 A1 Oct. 19, 2006

(30) Foreign Application Priority Data

Sep. 10, 2002 (KR) ..... 10-2002-0054690
Nov. 19, 2002 (KR) ..... 10-2002-0072085

(51) Int. Cl.
*F25D 19/00* (2006.01)

(52) U.S. Cl. ..... 62/295; 248/609

(58) Field of Classification Search ..... 62/295; 248/55, 609, 634
See application file for complete search history.

(56) References Cited

U.S. PATENT DOCUMENTS 2,644,420 A * 7/1953 Irgens ..... 416/135
3,197,983 A * 8/1965 Ilmer ..... 68/23.1
4,006,874 A * 2/1977 McGee ..... 248/74.3
4,888,962 A * 12/1989 Harper et al. ..... 62/503

FOREIGN PATENT DOCUMENTS

| | | | |
|---|---|---|---|
| CH | 668816 | A5 | 1/1989 |
| JP | 60-65289 | A | 4/1985 |
| JP | 61-129482 | A | 6/1986 |
| JP | 1-224483 | A | 9/1989 |
| JP | 5-1873 | U | 1/1993 |
| JP | 9-137788 | A | 5/1997 |
| JP | 2002-89977 | A | 3/2002 |

* cited by examiner

*Primary Examiner*—William E Tapolcai
(74) *Attorney, Agent, or Firm*—Birch, Stewart, Kolasch & Birch, LLP

(57) ABSTRACT

A hermetic compressor includes a compressor body, a suction pipe connected at one side of the compressor body to supply a refrigerant to the compressor body, and a suction pipe support unit having a bracket fixed at an outer circumferential surface of the compressor body to support the suction pipe and a strap mounted at both end portions of the bracket and having a bending part supported at an outer circumferential surface of the suction pipe and integrally formed at the central portion of the strap. The number of parts of the suction pipe support unit is decreased, reducing an assembly process, and vibration generated during a compression operation is reduced when being transferred to the suction pipe, preventing damage of the suction pipe and a suction pipe connection portion.

11 Claims, 8 Drawing Sheets

HERMETIC COMPRESSOR

TECHNICAL FIELD

The present invention relates to a hermetic compressor, and more particularly, to a hermetic compressor provided with a suction pipe support unit for supporting a suction pipe which supplies fluid to inside of a compressor.

BACKROUND ART

Conventionally, a hermetic compressor is divided into a rotary compressor, a reciprocating compressor, a scroll compressor, and etc. by a compression method of fluid, and is mainly used as a compressor for compressing a refrigerant in a refrigerating cycle.

FIG. 1 is a perspective view of a hermetic compressor provided with a suction pipe support unit in accordance with the conventional art.

The conventional hermetic compressor comprises: a compressor body 102; a suction pipe 104 connected to one side of the compressor body 102 for supplying a refrigerant to the compressor body 102; a discharge pipe 106 connected to an upper surface of the compressor body 102 for discharging a compressed refrigerant; an accumulator 108 connected to the suction pipe 104 for preventing a liquid refrigerant from being supplied to the compressor body 102; and a suction pipe support unit 110 installed between the suction pipe 104 and the compressor body 102 for supporting the suction pipe 104.

As shown in FIG. 2, the suction pipe support unit 110 comprises: a bracket 112 fixed to a lateral surface of the compressor body 102 by a welding method, and etc.; a holder 114 having both end portions fixed to the bracket 112 and provided with a mounting unit 116 for supporting an outer circumferential surface inside of the suction pipe 104 at a center thereof; and a strap 118 having both end portions fixed to the bracket 112 and supported at an outer circumferential surface outside of the suction pipe 104.

One end portions of the holder 114 and the strap 118 are respectively bent thus to be inserted into the bracket 112, and another end portions thereof are coupled to the bracket 112 by a bolt 120.

The conventional suction pipe support unit is assembled as follows. First, the bracket 112 is fixed to a lateral surface of the compressor body 102 by a welding, and one end portion of the holder 114 is inserted into the bracket 112. Next, the suction pipe 104 is mounted at the mounting unit 116 and then one end portion of the strap 118 is inserted into the bracket 112. Then, another end portions of the strap 118 and the holder 114 are coupled to the bracket 112 by the bolt 120, thereby completing an assembly.

However, in the conventional suction pipe support unit of the hermetic compressor, the bracket, the holder, and the strap are required thus to have a large number of components and thereby to have complicated assembly processes.

Also, since the suction pipe, the holder, and the strap are in contact with one another metallically, vibration generated during a compression operation is transmitted to the suction pipe, thereby damaging the suction pipe or a connection part between the suction pipe and the compressor body.

TECHNICAL GIST OF THE PRESENT INVENTION

Therefore, an object of the present invention is to provide a hermetic compressor capable of simplifying an assembly process and enhancing a productivity by reducing the number of components of a suction pipe support unit which supports a suction pipe.

Another object of the present invention is to provide a hermetic compressor capable of preventing damage of a suction pipe, a suction pipe connection part, and etc. by reducing a transmission of vibration generated during a compression operation to the suction pipe.

Still another object of the present invention is to provide a hermetic compressor capable of reducing a fabrication cost by installing only one accumulator to a refrigerating system without connecting the accumulator to each suction pipe in case of using a plurality of compressors for an enhanced refrigerant compression power.

DETAILED DESCRIPTION OF THE INVENTION

In order to achieve the above objects, there is provided a hermetic compressor comprising: a compressor body; a suction pipe connected to one side of the compressor body for supplying a refrigerant to the compressor body; and a suction pipe support unit composed of a bracket fixed to an outer circumferential surface of the compressor body for supporting the suction pipe, and a strap respectively mounted at both end portions of the bracket and having a bending part supported at an outer circumferential surface of the suction pipe and integrally formed at the center portion of the strap.

The bracket of the suction pipe support unit has a center portion fixed to an outer surface of the compressor body by a welding, and is provided with a bolt coupling hole at one end portion thereof.

The strap of the suction pipe support unit has a center portion bent with a certain angle and is provided with the bending part integrally formed towards a longitudinal direction. The strap is provided with an engaging hole inserted into the bracket at one end portion thereof, and is provided with a bolt penetration hole for passing a bolt at another end portion thereof.

The bending part of the suction pipe support unit is formed as a shape cut with a certain length by a pressing processing towards a longitudinal direction at the center of the strap thus to be plastically deformed to be supported at the outer circumferential surface of the suction pipe.

A vibration-proof member for absorbing vibration transmitted to the suction pipe from the compressor body is installed between an inner circumferential surface of the bending part of the suction pipe support unit and the outer circumferential surface of the suction pipe.

The vibration-proof member of the suction pipe support unit is formed of a rubber material of a ring shape having a certain thickness.

MODE FOR CARRYING OUT THE PREFERRED EMBODIMENTS

The present invention will now be described with reference to accompanying drawings.

Hereinafter, the most preferred embodiment of a hermetic compressor according to the present invention will be explained.

Figure 1:
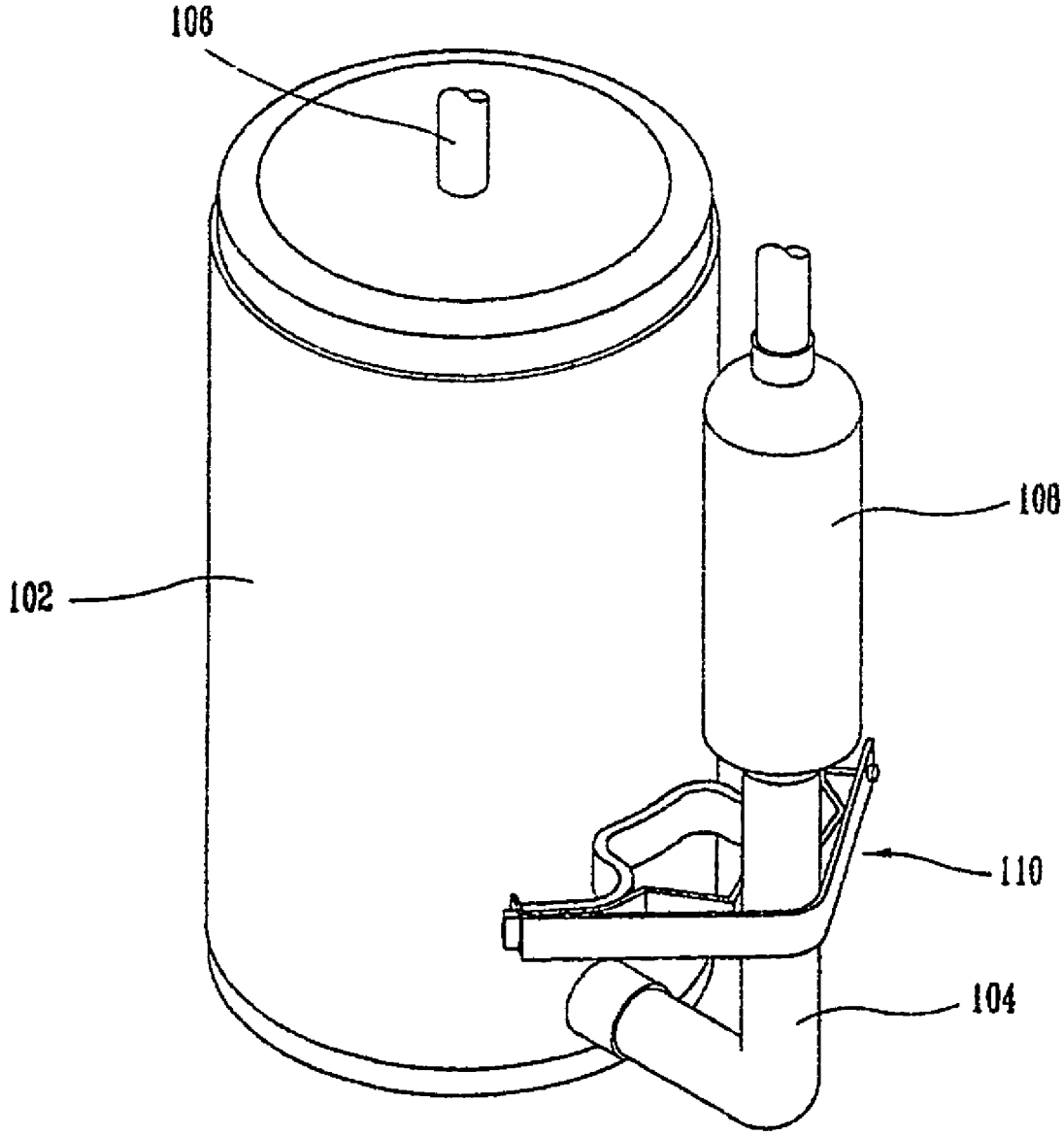
FIG. 1 BACKGROUND ART
FIG. 1 is a perspective view of a hermetic compressor provided with a suction pipe support unit in accordance with the conventional art.
Figure 2:
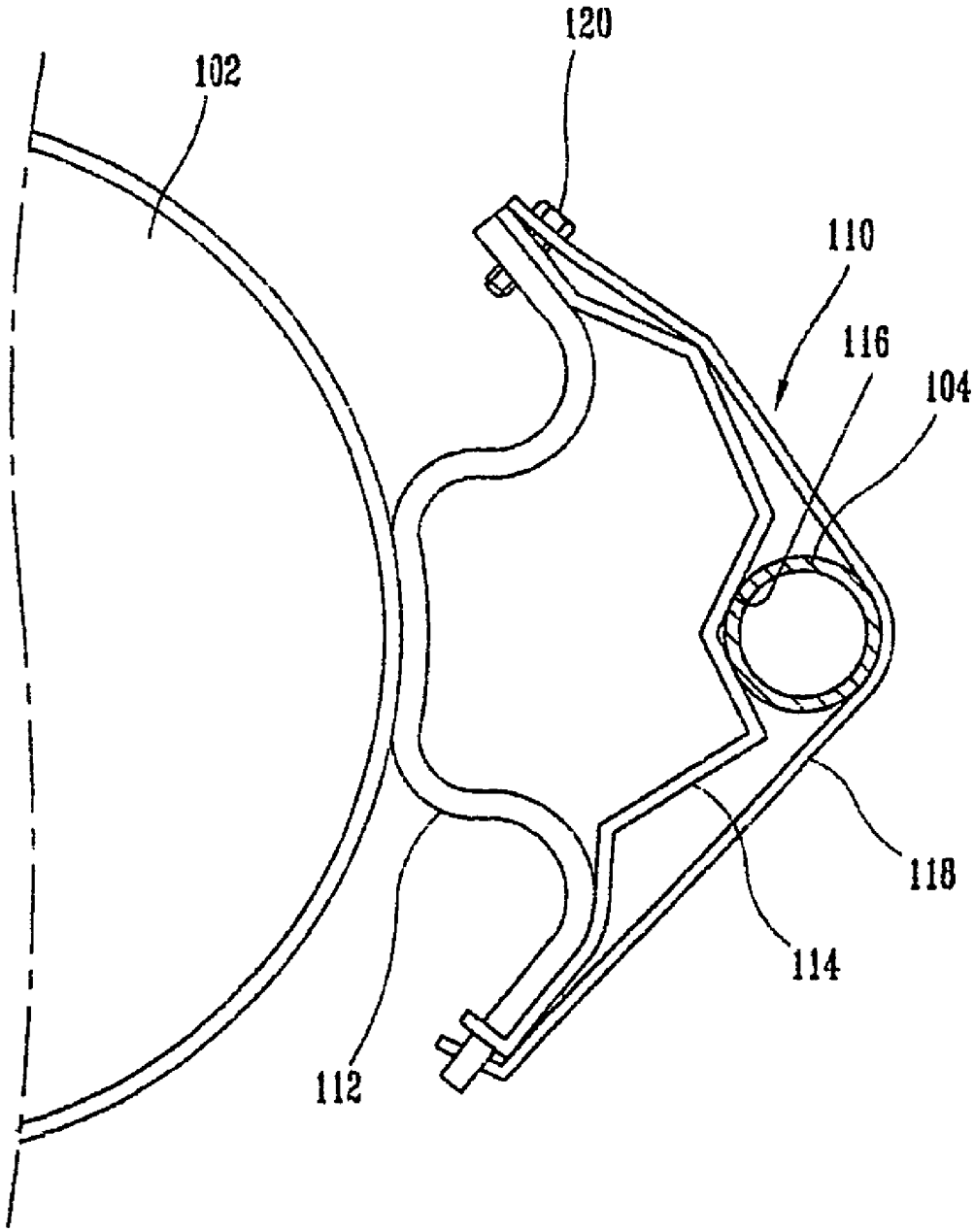
FIG. 2 BACKGROUND ART
FIG. 2 is an upper surface drawing showing the suction pipe support unit in accordance with the conventional art.
Figure 3:
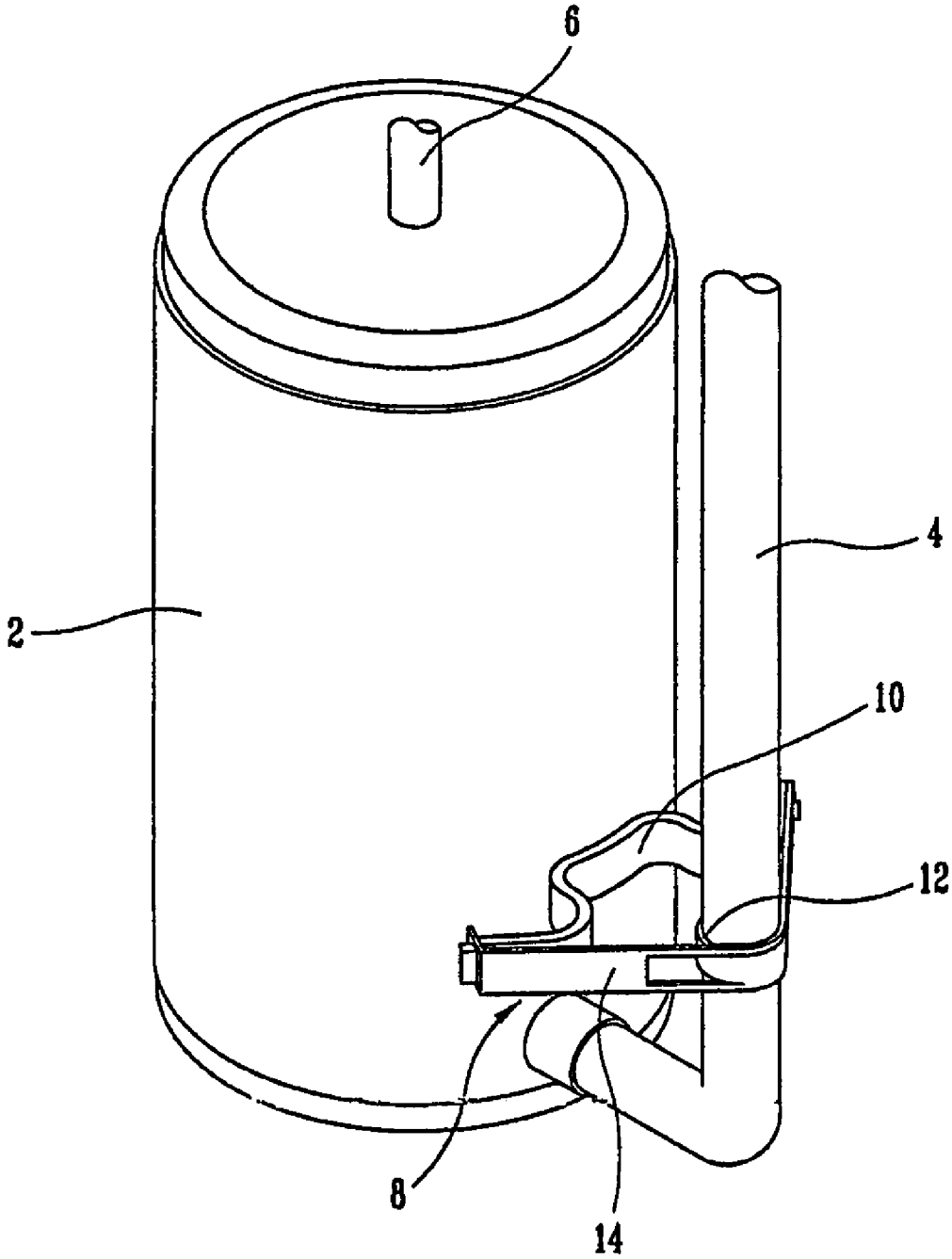
FIG. 3 is a perspective view of a hermetic compressor provided with a suction pie support unit according to one embodiment of the present invention.

FIG. 3 is a perspective view of a hermetic compressor provided with a suction pie support unit according to one embodiment of the present invention.

The hermetic compressor according to the present invention comprises a compressor body 2 in which each kind of component for compressing a refrigerant is mounted, a suction pipe 4 connected to a lateral surface of the compressor body 2 for supplying a refrigerant to the compressor body 2, and a discharge pipe 6 connected to an upper surface of the compressor body 2 for discharging a compressed refrigerant to outside.

The suction pipe 6 is an L-shaped pipe, and a suction pipe support unit 8 for supporting the suction pipe 6 is installed between the suction pipe 6 and the compressor body 2.

Figure 4:
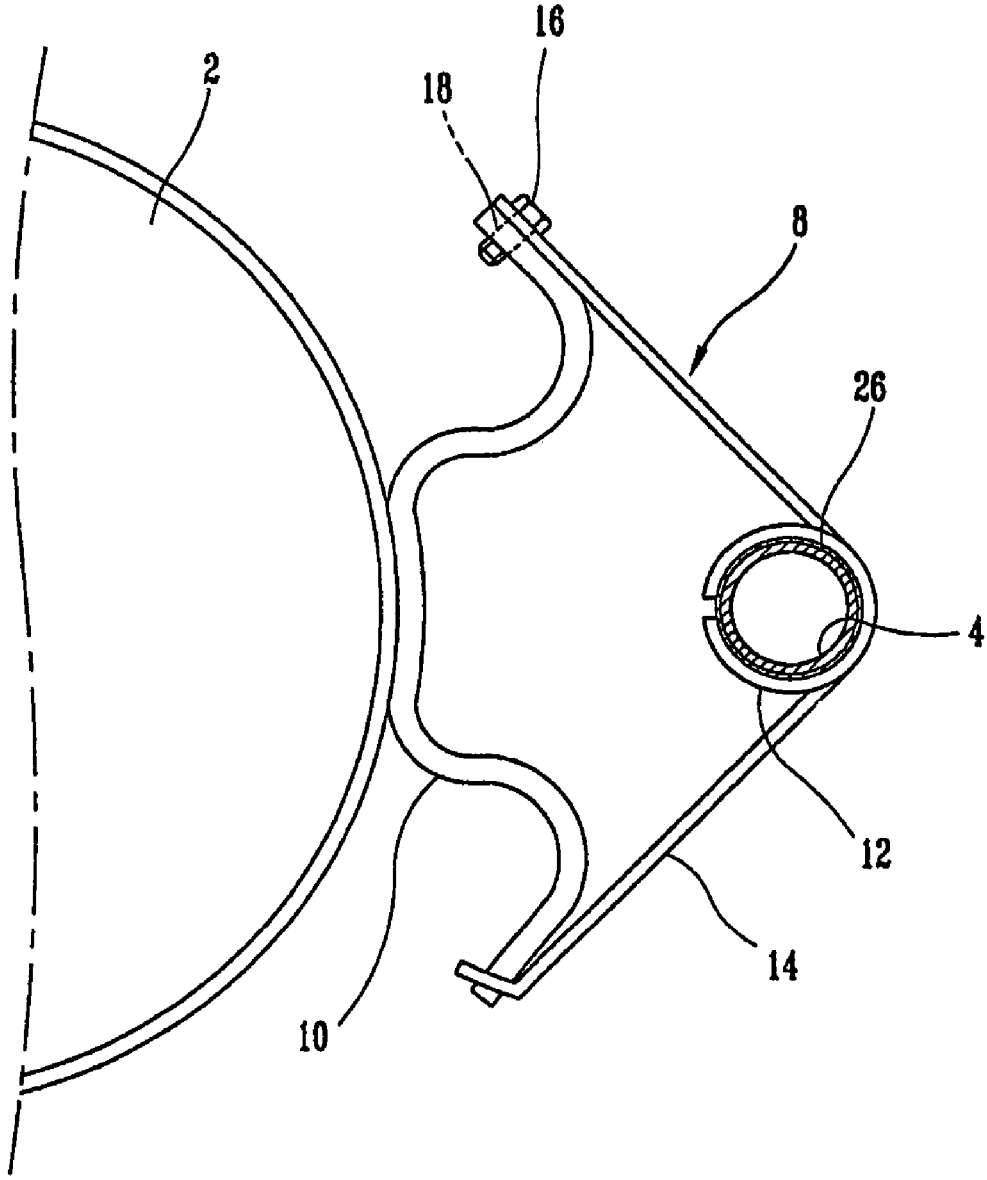
FIG. 4 is an upper surface drawing showing the suction pipe support unit according to one embodiment of the present invention.

The suction pipe support unit 8, as shown in FIG. 4, is composed of a bracket 10 fixed to an outer circumferential surface of the compressor body 2, and a strap 14 having both end portions respectively mounted at the bracket 10 and a bending part 12 supported at an outer circumferential surface of the suction pipe 4 and integrally formed at the center portion of the strap.

A center portion of the bracket 10 is fixed to a lateral surface of the compressor body 2 by a welding and etc., and both sides thereof are bent with a certain shape. A bolt coupling hole 18 for coupling a bolt is formed at one end portion of the bracket 10.

Figure 5:
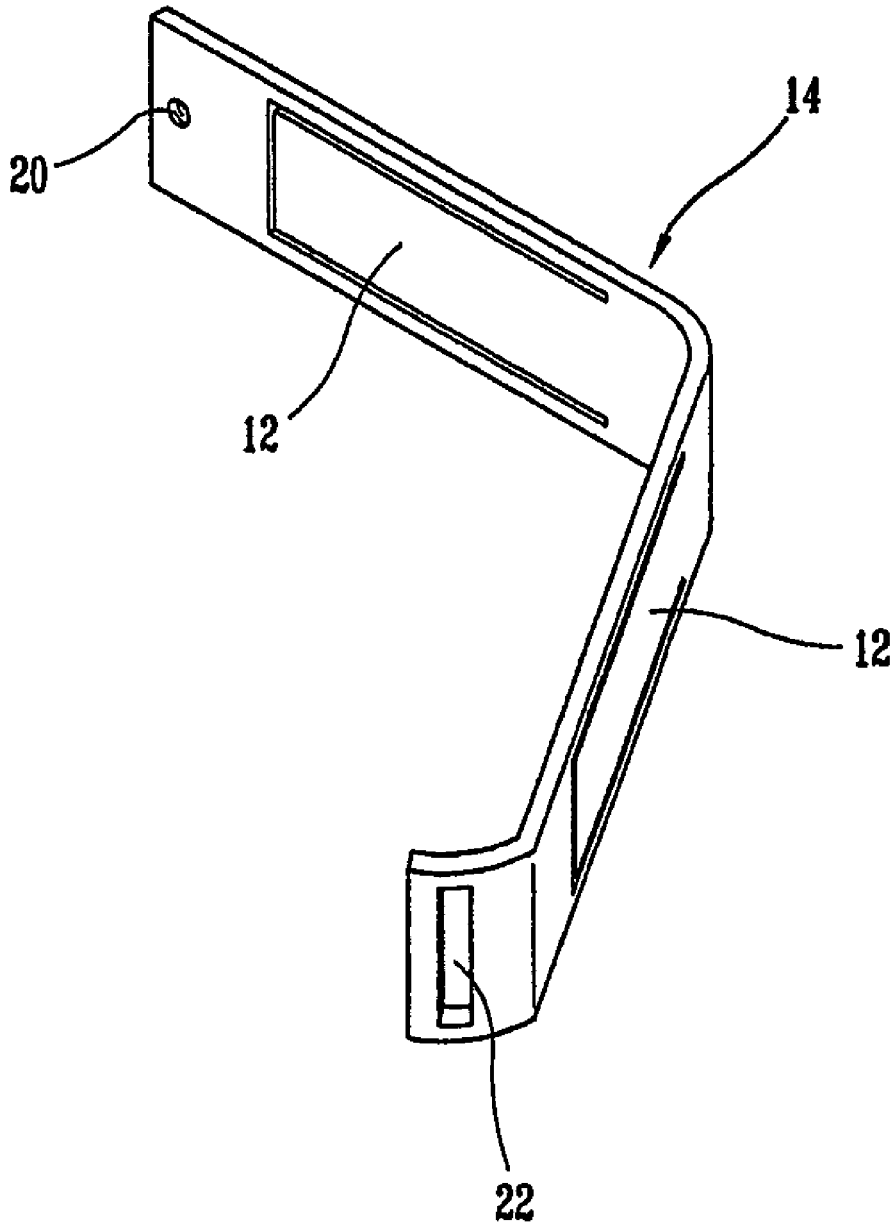
FIG. 5 is a perspective view of a strap of the suction pipe support unit according to one embodiment of the present invention.

The strap 14, as shown in FIG. 5, has a center portion bent with a certain angle, and is provided with a bending part 12 cut from the bent center towards both sides with a certain length and supported at an outer circumferential surface of the suction pipe 4. One end portion of the strap 14 is bent with a certain angle and is provided with an insertion hole 22 inserted into the bracket 10, and another end portion of the strap 14 is provided with a bolt penetration hole 20 for passing the bolt 16.

The bending part 12 is bent from the center of the strap 14 towards both sides longitudinal direction by a pressing process with a certain length thus to be supported at the outer circumferential surface of the suction pipe 4.

A vibration-proof member 26 for absorbing vibration transmitted to the suction pipe 4 from the compressor body 2 is installed between an inner circumferential surface of the bending part 12 and the outer circumferential surface of the suction pipe 4.

The vibration-proof member of the suction pipe support unit is preferably formed of a rubber material of a ring shape having a certain thickness.

Assembly processes of the suction pipe support unit according to one embodiment of the present invention will be explained as follows.

First, the bracket 10 is fixed to an outer circumferential surface of the compressor body 2 by a welding and etc. Then, the suction pipe 4 is positioned at inside of the strap 14. The insertion hole formed at one end portion of the strap 14 is inserted into one end portion of the bracket 10 thus to pass the bolt 16 through the bolt penetration hole 20 formed at one end portion of the strap 14. Then, the bolt 16 is coupled to the bolt coupling hole 16 of the bracket 10.

Under said state, the vibration-proof member 26 is inserted into the outer circumferential surface of the suction pipe 4 and the bending part 12 is bent to cover another surface of the vibration-proof member 26 thus to be fixed, thereby completing the assembly.

Figure 6:
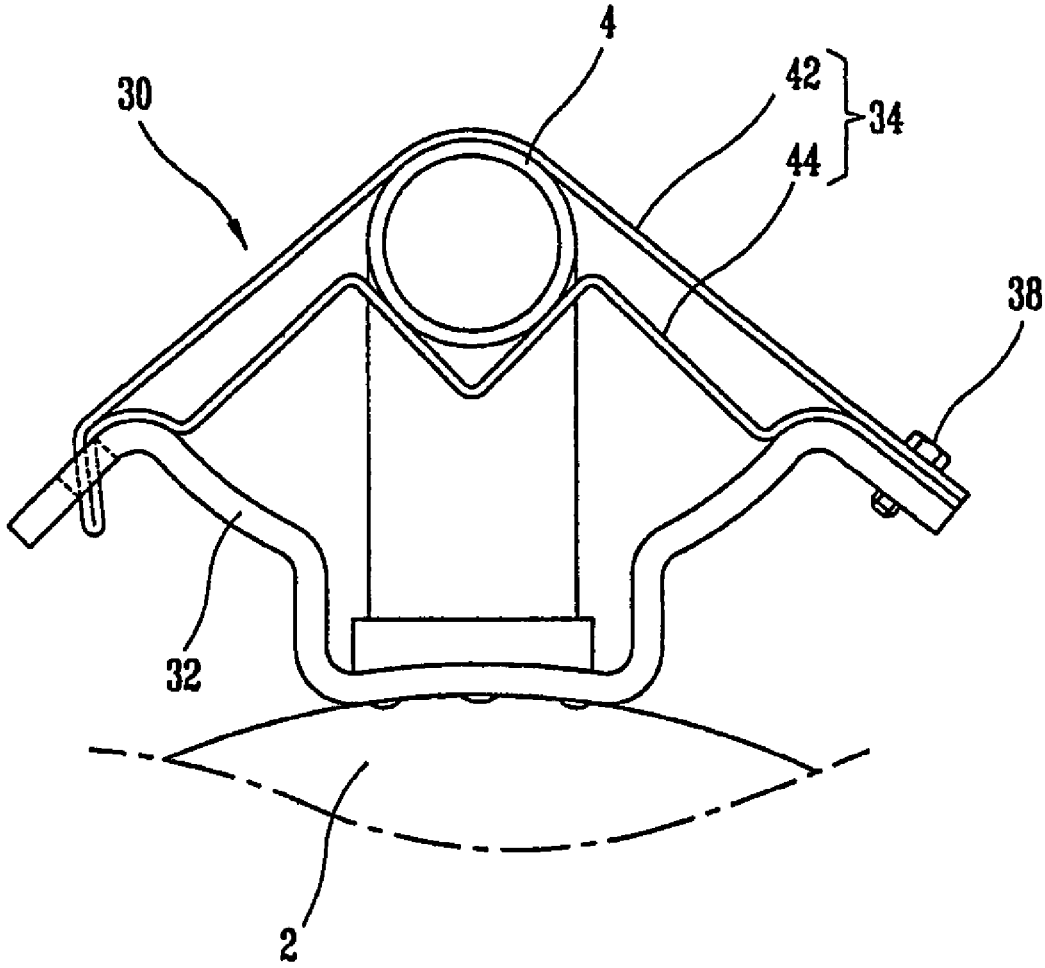
FIG. 6 is an upper surface drawing showing a suction pipe support unit according to a second embodiment of the present invention.

FIG. 6 is an upper surface drawing showing a suction pipe support unit according to a second embodiment of the present invention.

The suction pipe support unit 30 according to the second embodiment is composed of a bracket 32 fixed to the compressor body 2, and a strap 34 respectively coupled to both lateral surfaces of the bracket 32 and having a center portion for supporting the outer circumferential surface of the suction pipe 4.

Figure 7:
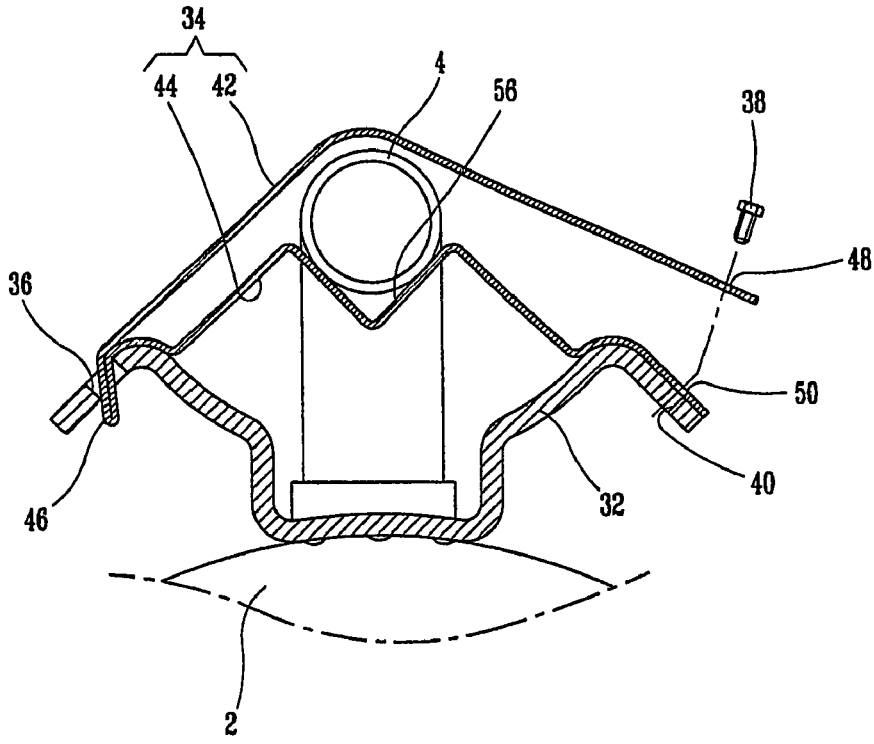
FIG. 7 is an assembly state view of the suction pipe support unit according to the second embodiment of the present invention.

As shown in FIG. 7, the bracket 32 has a center portion fixed to the outer circumferential surface of the compressor body 2 by a welding method, and etc., and both lateral surfaces thereof are bent with a certain shape. An insertion hole for inserting the strap 34 is formed at one end portion of the bracket 32, and a bolt coupling hole 40 for coupling a bolt 38 is formed at another end portion thereof.

Figure 8:
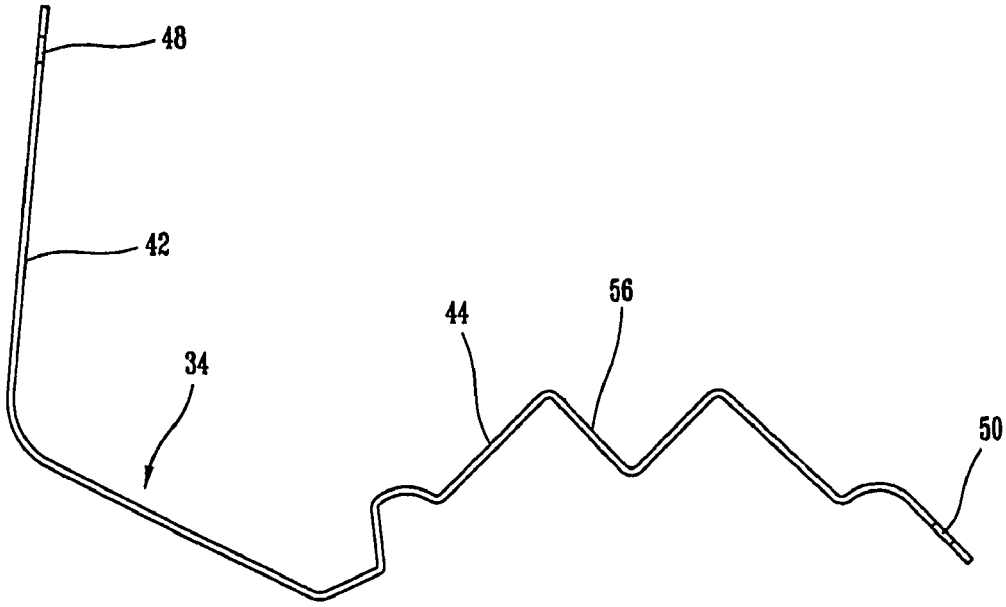
FIG. 8 is a lateral view of a strap of the suction pipe support unit according to the second embodiment of the present invention.

As shown in FIG. 8, the strap 34 is formed in a state that one flat plate is bent thus to be overlapped as two layers. The strap 34 is composed of a first supporting portion 42 positioned at an outer side between said two layers, and a second supporting portion 44 positioned at an inner side of the suction pipe. One end portion of the overlapped part of the first supporting portion 42 and the second supporting portion 44 is provided with an engaging portion 46 bent with a certain angle and inserted into the insertion hole 36 of the bracket 32, and another end portions of the first supporting portion 42 and the second supporting portion 44 are respectively provided with bolt penetration holes 48 and 50.

The first supporting portion 42 is bent with a certain angle to support an outer circumferential surface outside of the suction pipe 4, and a mounting unit 56 for mounting an outer circumferential surface inside of the suction pipe 4 is formed at the center portion of the second supporting portion 44.

The suction pipe support unit according to the second embodiment is assembled as follows.

First, the bracket 32 is fixed to an outer circumferential surface of the compressor body 2 by a welding and etc. Then, the second supporting portion 44 of the strap 34 is positioned inside the suction pipe 4, and the first supporting portion 42 is positioned outside the suction pipe 4, thereby inserting the engaging portion 46 into the insertion hole 36 formed at the bracket 32. Then, the bolt 38 is penetrated through the bolt penetration holes 48 and 50 of the first and second supporting portions 42 and 44, and then the bolt 38 is coupled to the bolt coupling hole 40 formed at the bracket 32, thereby completing the assembly.

At this time, the first supporting portion 42 is supported at the outer circumferential surface outside of the suction pipe 4, and the mounting unit 56 of the second supporting portion 44 is mounted at the outer circumferential surface inside of the suction pipe 4, thereby supporting the suction pipe 4.

The suction pipe support unit according to the first and second embodiment can be used in a refrigerating cycle having a plurality of compressors for an enhanced refrigerant compression power.

Figure 9:
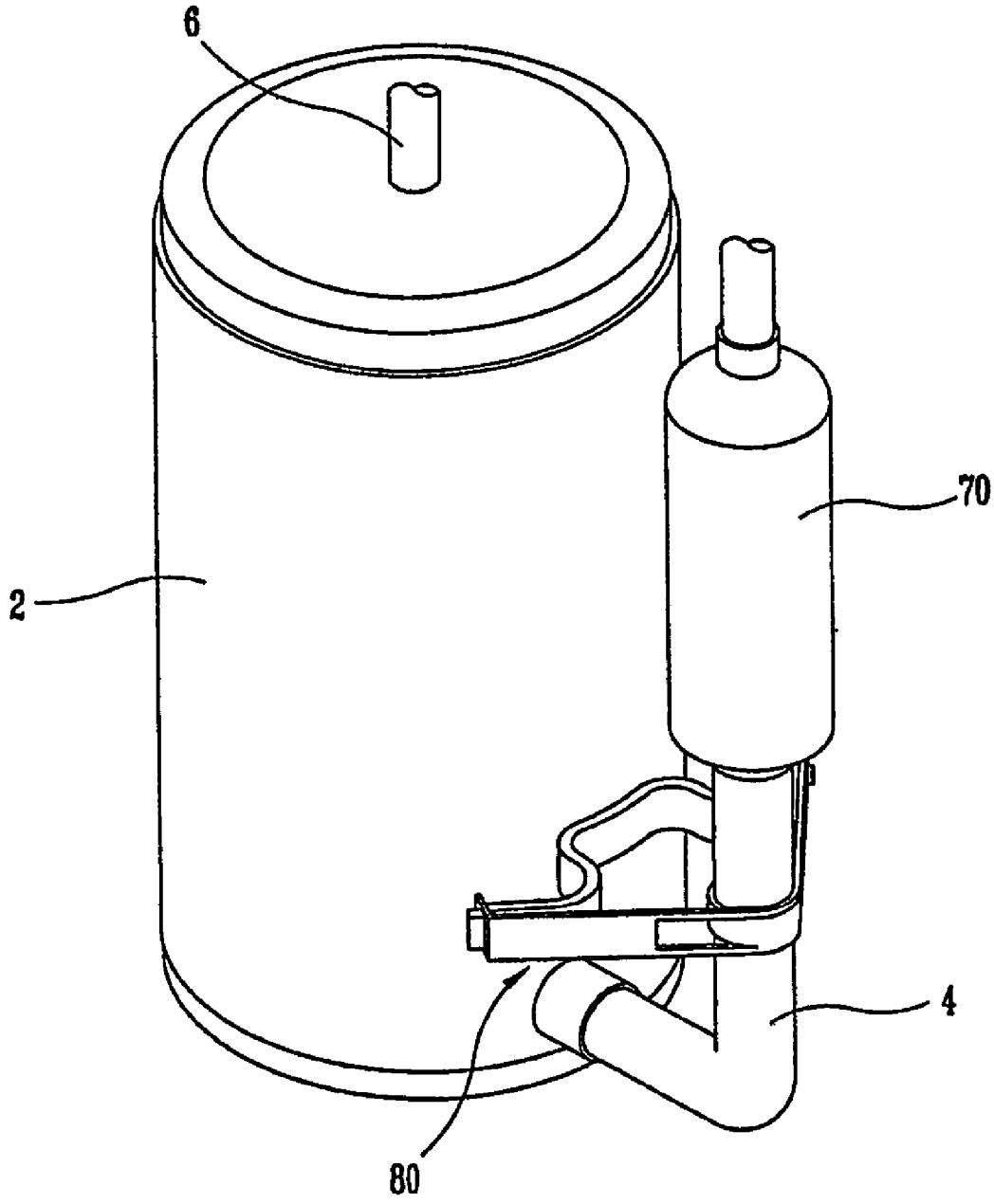
FIG. 9 is a perspective view of a hermetic compressor according to a third embodiment of the present invention.

FIG. 9 is a perspective view of a hermetic compressor according to a third embodiment of the present invention.

The hermetic compressor according to the third embodiment comprises: a compressor body 2; a suction pipe 4 connected to a lateral surface of the compressor body 2 for supplying a refrigerant to the compressor body 2; a discharge pipe 6 connected to an upper surface of the compressor body 2 for discharging a compressed refrigerant; an accumulator 70 connected to the suction pipe 4 for preventing a liquid refrigerant from being introduced into the compressor body 2; and a suction pipe support unit 80 installed between the suction pipe 4 and the compressor body 2 for supporting the suction pipe 4.

Either the suction pipe support unit 8 or the suction pipe support unit 30 explained in the first and second embodiment can be used as the suction pipe support unit 80, and the accumulator 70 is connected to the suction pipe 4 thus to prevent a liquid refrigerant from being introduced into the compressor body 2.

INDUSTRIAL APPLICABILITY

As so far described, according to the hermetic compressor of the present invention, since the suction pipe support unit for supporting the suction pipe is composed of the bracket and the strap, the number of components for supporting the suction pipe is reduced thus to simplify an assembly process and enhance a productivity.

Also, the vibration-proof member is installed between the suction pie and the suction pipe support unit thus to reduce transmission of a vibration generated at the compressor body during a compression operation to the suction pipe, thereby preventing damage of the suction pipe and the suction pipe connection part.

The invention claimed is:

1. A hermetic compressor, comprising:

a compressor body;

a suction pipe connected to one side of the compressor body for supplying a refrigerant to the compressor body; and a suction pipe support unit including a bracket fixed to an outer circumferential surface of the compressor body for supporting the suction pipe, and a strap respectively mounted at both end portions of the bracket and having two bending parts cooperatively supporting an outer circumferential surface of the suction pipe, each bending part cut from an interior portion of the strap.

2. The hermetic compressor of claim 1, wherein the bracket has a center portion fixed to an outer surface of the compressor body by a welding, and is provided with a bolt coupling hole for coupling a bolt at one end portion thereof.

3. The hermetic compressor of claim 1, wherein each bending part is bent with a certain angle, and the strap is provided with an engaging hole inserted into the bracket at one end portion thereof and is provided with a bolt penetration hole for passing a bolt at another end portion thereof.

4. The hermetic compressor of claim 3, wherein a vibration-proof member for absorbing vibration transmitted to the suction pipe from the compressor body is installed between an inner circumferential surface of the bending part and an outer circumferential surface of the suction pipe.

5. The hermetic compressor of claim 4, wherein the vibration-proof member of the suction pipe support unit is formed of a rubber material of a ring shape having a certain thickness.

6. The A hermetic compressor of claim 1, wherein the each bending part includes two parallel cut sides and a third cut side connecting endpoints of the two parallel cut sides, each bending part being substantially a mirror image of the other bending part relative to a line parallel to a centerline of the suction pipe, the endpoints connected to the third cut side located further from the centerline than endpoints of the two parallel lines not connected to the third cut side.

7. A hermetic compressor comprising:

a compressor body:

a suction pipe connected to one side of the compressor body for supplying a refrigerant to the compressor body; and a suction pipe support unit composed of a bracket fixed to an outer circumferential surface of the compressor body for supporting the suction pipe, and a strap respectively mounted at both end portions of the bracket and having a bending part supported at an outer circumferential surface of the suction pipe and integrally formed at the center portion of the strap, wherein the suction pipe support unit is composed of a bracket fixed to the compressor body and a strap having both end portions mounted at the bracket and having a center portion for supporting the suction pipe, the strap is composed of a first supporting portion and a second supporting portion formed accordingly as one member is overlapped as double layers, and the suction pipe is supported between the first supporting portion and the second supporting portion.

8. The hermetic compressor of claim 7, wherein the bracket has a center portion fixed to an outer circumferential surface of the compressor body by a welding, and is provided with an insertion hole for inserting the strap at one end portion thereof and is provided with a bolt coupling hole for coupling a bolt at another end portion thereof.

9. The hermetic compressor of claim 8, wherein the first supporting portion is positioned at an outer side of the suction pipe and the second supporting portion is positioned at an inner side of the suction pipe, one end portion of the overlapped part of the first supporting portion and the second to supporting portion is provided with an engaging portion inserted into the insertion hole of the bracket, and another end portions of the first supporting portion and the second supporting portion are respectively provided with bolt penetration holes coupled to the bolt coupling holes by a bolt.

10. The hermetic compressor of claim 9, wherein the first supporting portion is bent with a certain angle to support an outer circumferential surface outside of the suction pipe, and a mounting unit for mounting an outer circumferential surface inside of the suction pipe is formed at a center portion of the second supporting portion.

11. A hermetic compressor comprising:

a compressor body;

a suction pipe connected to one side of the compressor body for supplying a refrigerant to the compressor body;

an accumulator connected to the suction pipe for preventing a liquid refrigerant from being introduced into the compressor body; and a suction pipe support unit composed of a bracket fixed to an outer circumferential surface of the compressor body for supporting the suction pipe, and a strap respectively mounted at both end portions of the bracket and having a bending part supported at an outer circumferential surface of the suction pipe and integrally formed at a center portion of the strap, wherein the suction pipe support unit is composed of a bracket fixed to the compressor body and a strap having both end portions mounted at the bracket and having a center portion for supporting the suction pipe, the strap is composed of a first supporting portion and a second supporting portion formed accordingly as one member is overlapped as double layers, and the suction pipe is supported between the first supporting portion and the second supporting portion.

* * * * *